US007001044B2

(12) United States Patent
Leen

(10) Patent No.: US 7,001,044 B2
(45) Date of Patent: Feb. 21, 2006

(54) MULTIPLE HEAD WORKLIGHT

(76) Inventor: Monte A. Leen, 11730 NE. 12th St., Bellevue, WA (US) 98005

( * ) Notice: Subject to any disclaimer, the term of this patent is extended or adjusted under 35 U.S.C. 154(b) by 0 days.

(21) Appl. No.: 10/913,036

(22) Filed: Aug. 6, 2004

(65) Prior Publication Data

US 2005/0083692 A1 Apr. 21, 2005

Related U.S. Application Data

(60) Provisional application No. 60/493,962, filed on Aug. 8, 2003.

(51) Int. Cl.
*F21S 13/14* (2006.01)

(52) U.S. Cl. ..... 362/252; 362/249; 362/250; 362/399; 362/426; 362/431

(58) Field of Classification Search ..... 362/249–252, 362/371, 376, 399, 426, 431
See application file for complete search history.

(56) References Cited

U.S. PATENT DOCUMENTS 5,272,609 A * 12/1993 Nelson ..... 362/250
6,939,021 B1 * 9/2005 Leslie et al. ..... 362/252
2003/0103357 A1 * 6/2003 Drake et al. ..... 362/431

* cited by examiner

*Primary Examiner*—Stephen F Husar
(74) *Attorney, Agent, or Firm*—Dean A. Craine

(57) ABSTRACT

A portable worklight designed to illuminate a 360 degree area. The worklight includes a triangular-shaped base with three side members. Mounted on each side member is a rotating and pivoting light head that includes two diagonally aligned light cavities. Mounted inside each light cavity is a horizontally aligned halogen bulb with a concave reflective shield mounted behind the bulb. Mounted over the front face of each light cavity is a glass plate and a chevron-shaped frame. Attached to the rear surface on each worklight includes a handle. Each light head is mounted on a rotating U-shaped bracket that allows the head to rotate upward and downward approximately 45 degrees. The bracket is also able to rotate 360 degrees over the side member. Each light head also includes a separately operated ON-OFF switch that controls the operation of the halogen bulbs contained therein.

15 Claims, 6 Drawing Sheets

MULTIPLE HEAD WORKLIGHT

This utility patent application claims the benefit of provisional patent application (Ser. No. 60/493,962) filed on Aug. 8, 2003.

BACKGROUND OF THE INVENTION

1. Field of the Invention

This invention pertains to worklights and more particularly to worklights designed to illuminate a wide area.

2. Description of the Related Art

When working in a dark work area, it is sometimes desirable to illuminate a wide area with few shadows. Typically, this requires the use of several worklights aimed at different work areas that slightly overlap. Unfortunately, this requires multiple worklights spaced apart in the work area each with their own use of several extension cords that can be easily tripped over by workers.

Multiple head worklights mounted longitudinally on a rigid bar are relatively common. All of them include legs that allow them to be placed upright on the ground. Some multiple head worklights include a telescopic pole that allows the worklights to be elevated. While most multiple head worklights are adjustable so that the heads may be aimed in different directions, none of them can illuminate a circular area.

SUMMARY OF THE INVENTION

It is an object of the present invention to provide a multiple head worklight.

It is another object of the present invention to provide such a worklight that can be used to illuminate a 360 degree, circular area.

It is another object of the present invention to provide such a worklight that can be attached to a pole or placed on the ground.

These and other objects of the present invention are met by a portable worklight disclosed herein that includes a triangular-shaped base with three dual light heads attached to the base's three legs. Each light head includes two diagonally aligned light cavities separated by a vertically aligned transversely aligned partition. Mounted inside each light cavity is a longitudinally aligned halogen bulb. Located behind the halogen bulb is an optional concave reflective shield. Mounted over the front face of each light cavity is an optional glass plate designed to protect the halogen bulb. A chevron-shaped face frame is disposed over the two faces on each light head and used to hold and protect the two glass plates mounted thereon. Also attached to the rear surface on each light head, is a handle that allows each light head to be independently aimed.

Each light head is mounted on a u-shaped frame that holds and elevates the light head above the base. The u-shaped frame is rotatably mounted to the base, which enables the light head to rotate side-to-side in an approximately 80 degrees arc. Each light head is rotatably mounted between two vertical side members on the u-shaped frame so that it may also be tilted upward and downward approximately 45 degrees. Each light head also includes a separate ON-OFF switch that allows the user to independently control the operation of the two halogen bulbs in each light head.

Located centrally and extending transversely between two side members on the base is a rigid center frame member. Attached and perpendicularly aligned on the center frame member is an upward extending handle that allows the entire worklight to be easily carried. Mounted on the handle is an optional power box assembly that includes a main power cord that delivers electric power to three branch power cords that connect to the three ON-OFF switches on the three light heads. Attached to the three corners of the base are three optional feet that extend downward to allow the base to be placed on the flat surface.

The worklight may include an optional height adjustable pole that allows the multiple head worklight to be elevated.

DESCRIPTION OF THE PREFERRED EMBODIMENT(S)

Figure 1:
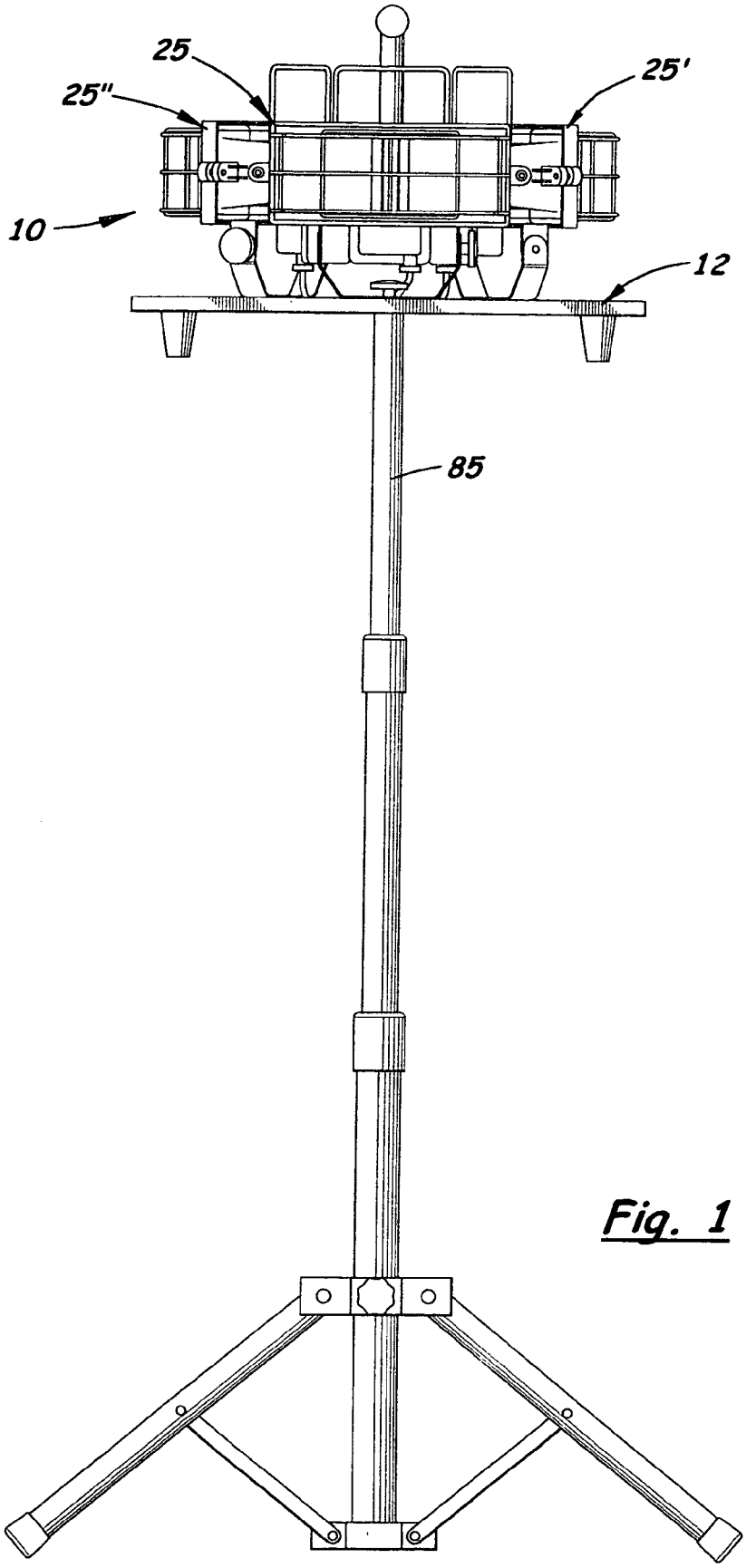
FIG. 1 is a front elevational view of the multiple head worklight mounted on a telescopic pole.
Figure 2:
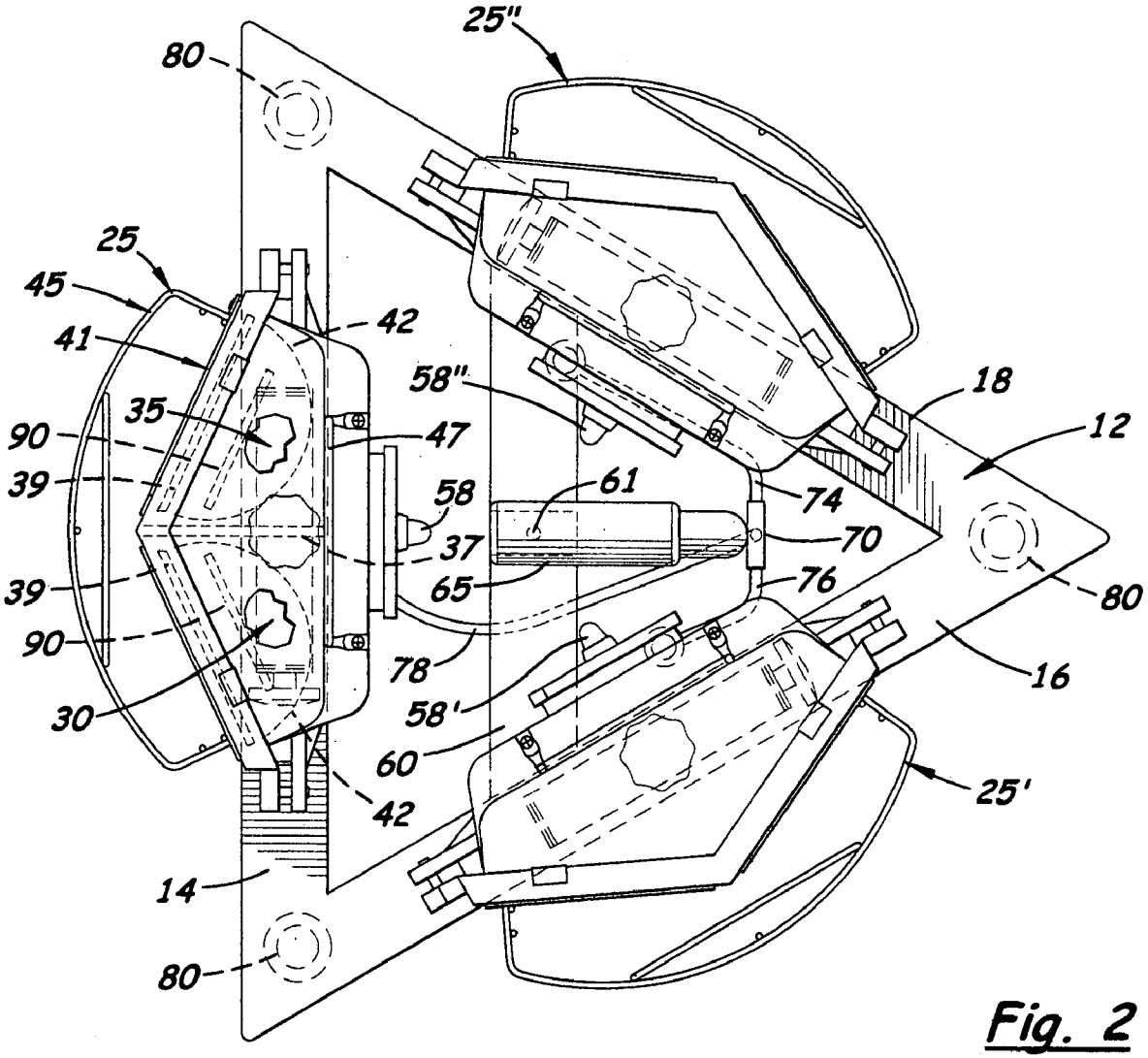
FIG. 2 is a top plan view of the multiple head worklight shown in FIG. 1
Figure 3:
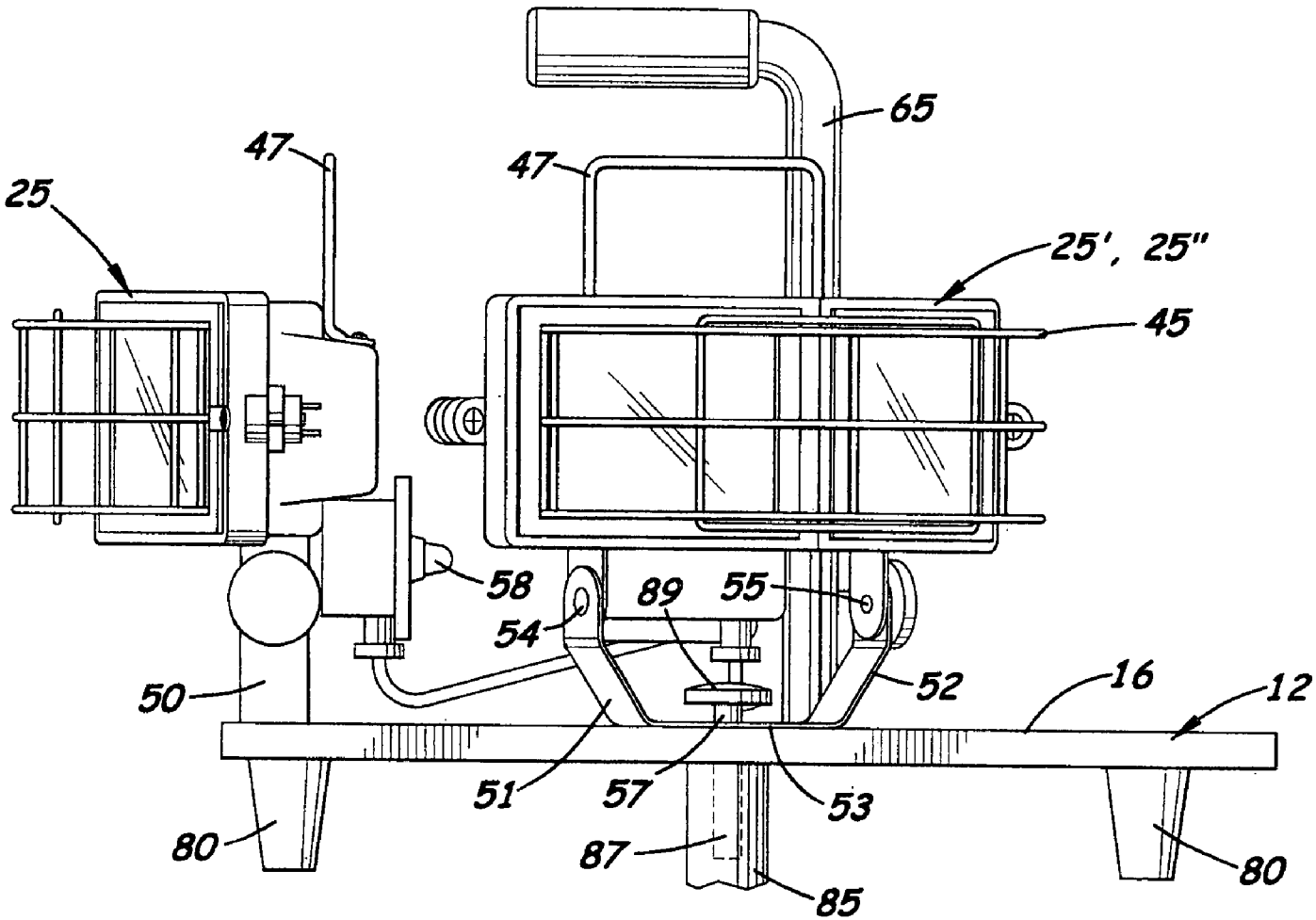
FIG. 3 is a left side elevational view of the worklight shown in FIG. 1.
Figure 4:
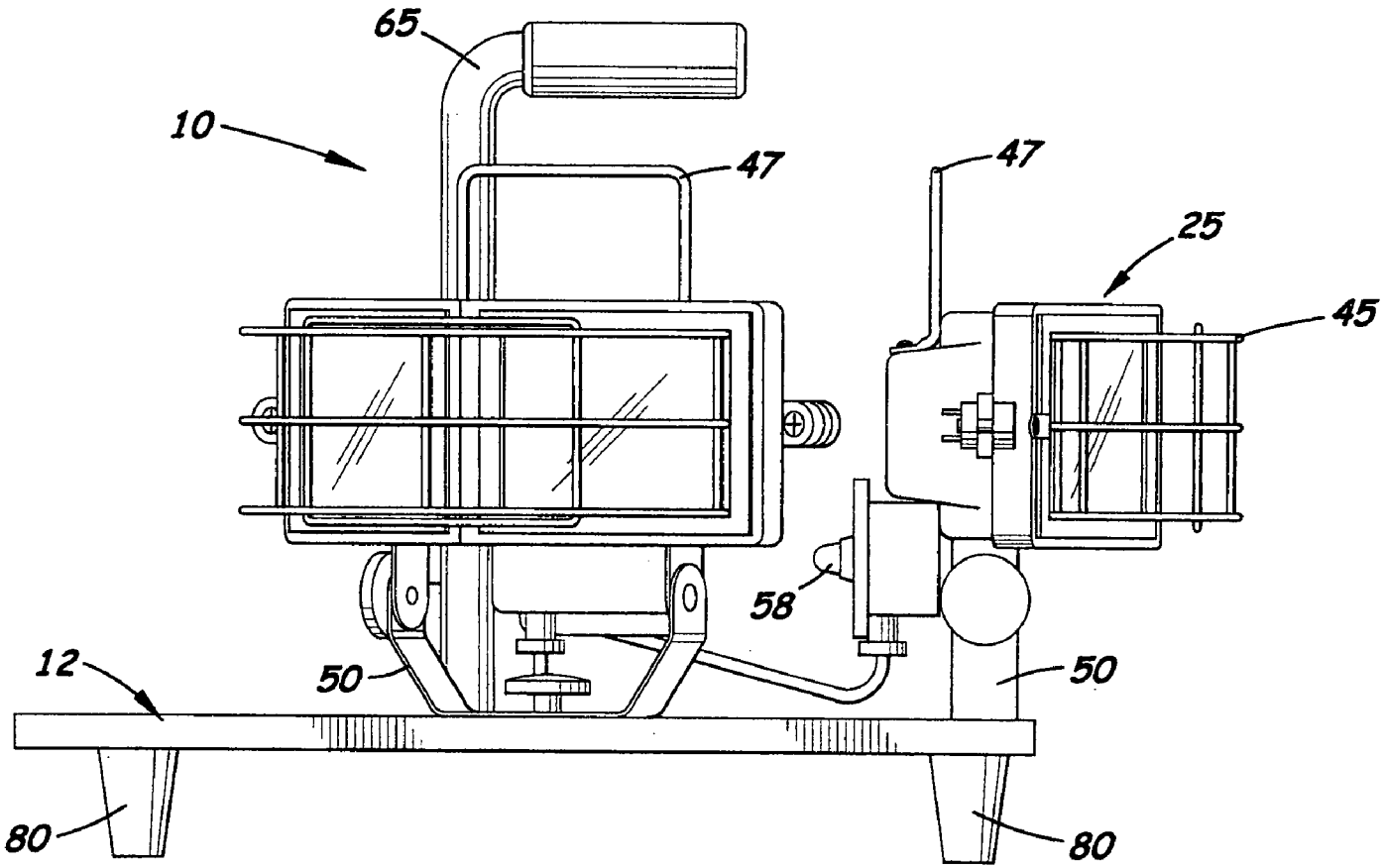
FIG. 4 is a right side elevational view of the worklight shown in FIG. 1.
Figure 5:
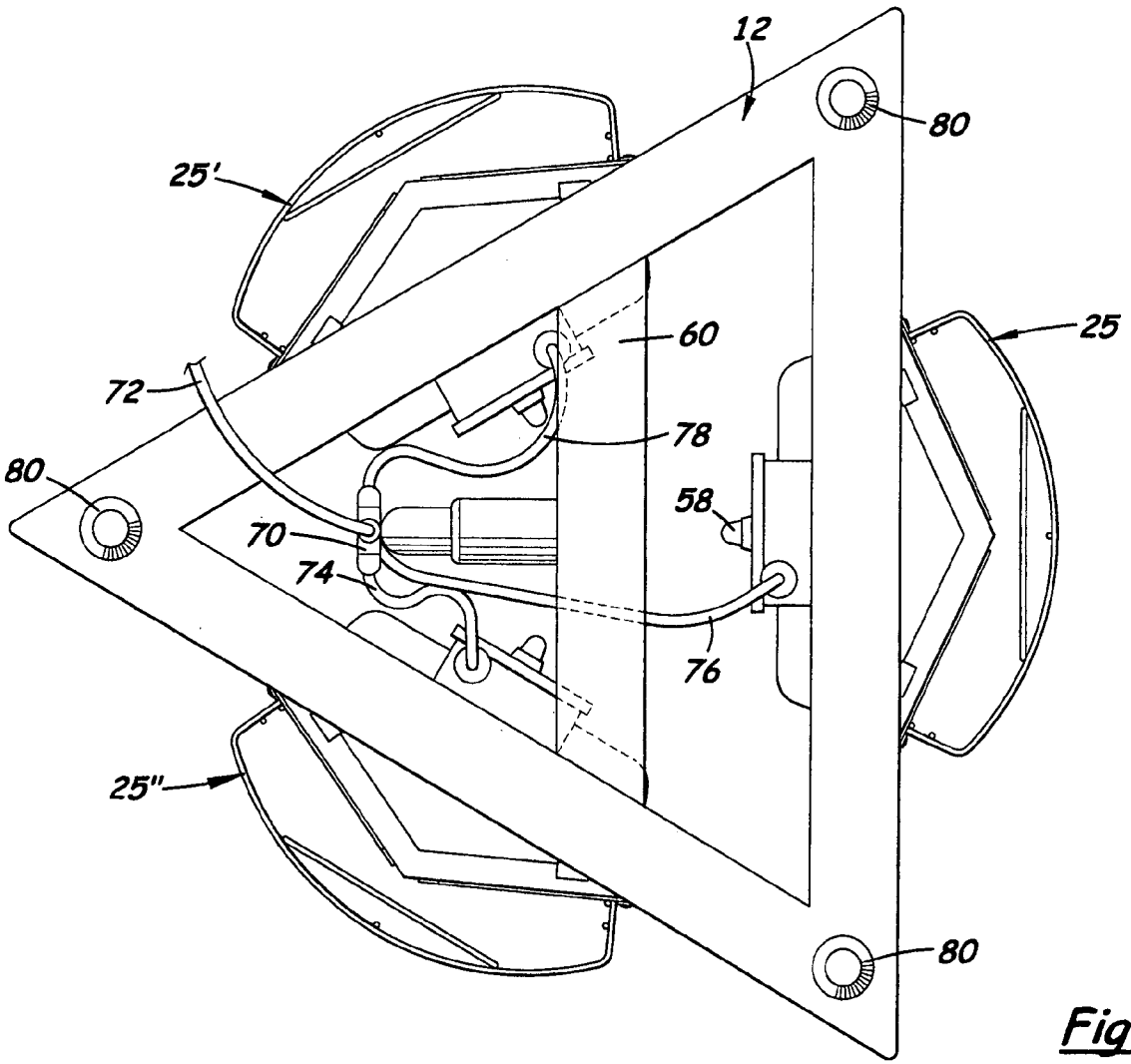
FIG. 5 is a bottom plan view of the worklight shown in FIG. 1.
Figure 6:
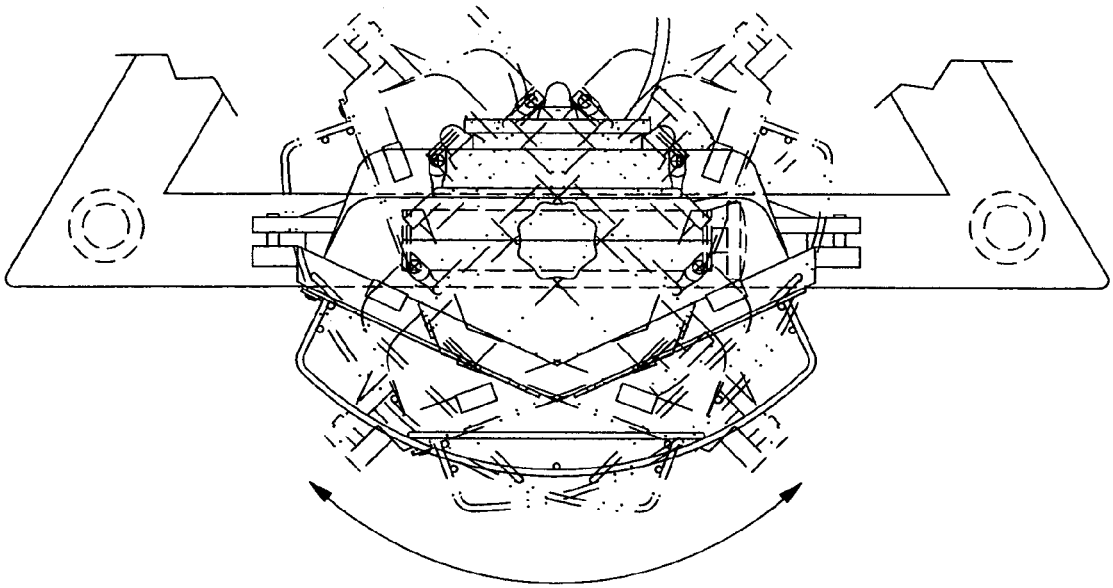
FIG. 6 is an illustration showing the rotational movement of one worklight over the base.
Figure 7:
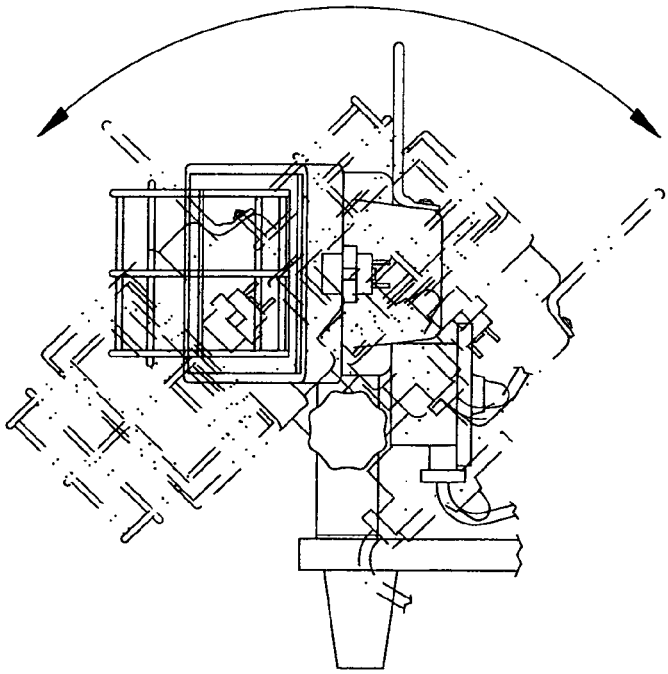
FIG. 7 is an illustration showing the rotational movement of one worklight over the base along a horizontal axis.

There is shown in the accompanying FIGS. 1–7 a portable worklight, generally referenced as 10 that includes a triangular-shaped base 12 with three dual bulb light heads 25, 25', 25" attached thereto. The base 12 includes three side members 14, 16, 18 welded together at their opposite ends. Each light head 25 includes two diagonally aligned light cavities 30, 35 separated by a partition 37. The light cavities 30, 35 are diagonally aligned approximately 40 degrees from the center of the light head. Mounted inside each light cavity 30, 35 is a longitudinally aligned halogen bulb 90. Located behind the halogen bulb 90 is a concave reflective shield 42. Mounted over the front face of each light cavity 30, 35 is a glass plate 39 designed to protect the halogen bulb 90. A chevron-shaped face frame 41 is used to hold the two glass plates 39, 39' in place on the light head 25 and over the two cavities 30, 35 respectively. Extending transversely over the two plates 39, 39' is an optional wire cage 45. Also, attached to the rear surface on each light head 25 includes a vertical handle 47 that allows each light head 25 to be independently adjusted on the triangular-shaped base 12.

Each light head 25 is mounted on a rotating u-shaped bracket 50 that elevates the light head 25 above the base 12 and allows the light head 25 to rotate side to side approximately 40 degrees. The bracket 50 includes two vertical side arms 51, 52, and a transverse arm 53. Pins 54, 55 are attached to the inside surfaces side arms 51, and 52 respectively, that connect to bores (not shown) located on brackets that extend downward from the light head 25. The pins 54, 55 allow the light head 25 to rotate around a horizontal axis parallel to the top surface of the base 12. During use, each light head 25 may be aimed upward and downward approximately 45 degrees. The bracket 50 includes a center pin 57 that extends through the transverse arm 53 and adjacent side member 14, 16, or 18 to pivotally attach the bracket 50 to the base 12. Each light head 25 includes an optional ON-OFF switch 58 that allows the user to independently control the operation of two halogen bulbs 90 located therein.

Extending centrally on the base 12 and parallel to one side member 14 is a flat, center frame member 60. Attached and perpendicularly aligned on the center frame member 60 is an upward extending handle 65. The handle 65 is slightly off center to accommodate a bore 61 formed on the frame member 60. Mounted on the handle 65 is a power box assembly 70 that includes a main power cord 72 and three branch power cords 74, 76, and 78. The branch power cords 74, 76, 78 connect to switches 58, 58', 58" located on the back surfaces of the light heads 25, 25', 25" respectively. Wires from each switch 58, 58', 58" connect to the halogen bulb connectors (not shown) located inside each light head 25. Also, attached to the bottom surface of the base 12 at each corner are three downward extending legs 80.

In the preferred embodiment, the legs 80 are made of rubber and connected to the base 12 with suitable threaded connectors (not shown).

Formed centrally on the center frame member 60 is a bore 61. Included with the worklight 10 is an optional telescopic pole 85. Formed to the distal end of the pole 85 is a threaded bore 87. During use, the worklight 10 is raised and perpendicularly aligned over the distal end of the pole 85 so that bore 61 is aligned and registered over the bore 87. A threaded pin 57 with a handle 89 attached at one end is extended through bores 61 and 87 to attach the worklight 10 to the pole 85.

In the preferred embodiment, the side members 14, 16, 18 on the triangular base 12 measure approximately 17 inches in length. The side members 14, 16, 18 are made of lightweight, rectangular tubing material made of aluminum or thin-wall steel. The legs 80 are conical and approximately 2 inches in length. Each light head 25, 25, 25" is approximately 10 inches in width, 6 inches in length, and 6 inches in height. The light cavity on each light head 12 measures approximately 5½ by 4½ inches. The handle 65 is made of aluminum or steel tubing and measures approximately 12 inches in length.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A portable worklight, comprising:

a. a triangular-shaped base with three side members and a transversely aligned central frame member;

b. a light head mounted on each said side member, each said light head including at least one cavity with at least one halogen bulb mounted longitudinally therein, each said light head also including a front opening with a removable face frame thereover;

c. a means for rotating each said light head vertically over said base;

d. a means for rotating each said light head horizontally over said base;

e. a handle attached to said base;

f. a switch means connected to said halogen bulb located in said light head; and, g. a power cord connected to said switch means used to electronically connect said switch means to an electric power source.

2. The portable worklight, as recited in claim 1, further including a plurality of feet attached to said base to support said base on a support surface.

3. The portable worklight, as recited in claim 1, wherein said handle is attached to said central frame member and extends perpendicularly and upward from said base.

4. The portable worklight, as recited in claim 1, further including a vertical pole perpendicularly aligned and attached to said base thereby elevating said base of above a support surface.

5. The portable worklight, as recited in claim 4, further including a bore formed on said center frame member, a threaded bore formed on said pole, and a threaded bolt capable of extending through and connecting to said threaded bore to connect said base to said pole.

6. The portable worklight, as recited in claim 1, wherein said means for allowing said light head to rotate vertically on said base is a U-shaped bracket attached to said base, said brackets includes two vertical side arms and a lower transverse arm, said transverse arm being pivotally attached to one said side member on said base.

7. The portable worklight, as recited in claim 6, wherein said means for rotating each said light head horizontally over said base are two pins disposed between the sides of said light head and said side arms on side bracket.

8. The portable worklight, as recited in claim 1 wherein each said light head includes two diagonally aligned cavities with at least a halogen bulb disposed therein, each said diagonally aligned cavity including a front opening.

9. The portable worklight, as recited in claim 8, further including a reflective shield located inside each said cavity.

10. The portable worklight, as recited in claim 1, further including a glass plate attached over said front opening.

11. The portable worklight, as recited in claim 9, further including two glass plates disposed are each said front openings on said diagonally aligned cavities.

12. The portable worklight, as recited in claim 11, further including a face frame disposed over each said front opening on said diagonally aligned cavities.

13. A portable worklight, comprising:

a. a triangular-shaped base with three side members and a transversely aligned central frame member;

b. a light head including at least one cavity with at least one halogen bulb mounted longitudinally therein, each said light head also including a front opening with a removable face frame thereover;

c. a U-shaped bracket pivotally attached to one said side member on said base, said U-shaped bracket including two vertical arms that extend upward and hold one said light head;

d. an upward extending handle attached to and perpendicularly aligned with said base;

e. a switch means connected to said halogen bulb located in said light head; and f. a power cord connected to said switch means used to electronically connect said switch means to an electric power source.

14. The portable worklight, as recited in claim 13, further including a vertical pole perpendicularly aligned and attached to said base thereby elevating said base of above a support surface.

15. The portable worklight, as recited in claim 14, further including a bore formed on said center frame member, a threaded bore formed on said pole, and a threaded bolt capable of extending through and connecting to said threaded bore to connect said base to said pole.

* * * * *